US011608211B2

(12) United States Patent
Kloke et al.

(10) Patent No.: US 11,608,211 B2
(45) Date of Patent: Mar. 21, 2023

(54) TRANSPORT PACKAGING FOR CONTAINERS AND METHOD OF UNPACKING CONTAINERS

(71) Applicant: SCHOTT Pharma Schweiz AG, St. Gallen (CH)

(72) Inventors: Arne Kloke, St. Gallen (CH); Rainer Landich, Herrnburg (DE); Michael Scheidbach, Hauptwil (CH); Aldin Imsic, St. Gallen (CH); Tobias Diener, Constance (DE); Leah Kidney, Lugano (CH)

(73) Assignee: SCHOTT Pharma Schweiz AG, St. Gallen (CH)

( * ) Notice: Subject to any disclaimer, the term of this patent is extended or adjusted under 35 U.S.C. 154(b) by 0 days.

(21) Appl. No.: 16/942,172

(22) Filed: Jul. 29, 2020

(65) Prior Publication Data

US 2021/0031980 A1 Feb. 4, 2021

(30) Foreign Application Priority Data

Jul. 30, 2019 (EP) ..... 19189116

(51) Int. Cl.
*B65D 25/10* (2006.01)
*B65B 69/00* (2006.01)
*B65D 1/34* (2006.01)

(52) U.S. Cl.
CPC ..... *B65D 25/108* (2013.01); *B65B 69/00* (2013.01); *B65D 1/34* (2013.01)

(58) Field of Classification Search
CPC ..... B65D 25/108; B65D 25/10; B65D 71/00; B65D 71/0003; B65D 71/0007; B65D 1/34; B65D 1/36; B65D 2571/00123
(Continued)

(56) References Cited

U.S. PATENT DOCUMENTS 4,844,234 A 7/1989 Born et al.
6,408,768 B1 * 6/2002 Giampavolo ..... B65D 19/38 108/27

(Continued)

FOREIGN PATENT DOCUMENTS

EP 3 345 587 A1 7/2018
GB 539258 9/1941

OTHER PUBLICATIONS

European Communication dated Jul. 21, 2021 for European Patent Application No. 19 189 116.7 (4 pages).

(Continued)

*Primary Examiner* — Javier A Pagan

(74) *Attorney, Agent, or Firm* — Taylor IP, P.C.

(57) ABSTRACT

A transport packaging includes a tray formation which is configured to hold a plurality of containers with mutual separation to avoid mutual contact of the containers. The tray formation includes a first tray part having a plurality of pockets configured to receive first ends of the containers and a second tray part removably coupled to the first tray part and having a corresponding plurality of pockets configured to receive second ends of the containers. The first tray part is formed such that, when the second tray part is removed so that the second ends of the containers are free from the pockets of the second tray part, the free second ends of the containers are free to be brought into mutual contact while the first ends of the containers are still received in the pockets of the first tray part.

20 Claims, 13 Drawing Sheets

(58) Field of Classification Search
USPC ..... 206/597
See application file for complete search history.

(56) References Cited

U.S. PATENT DOCUMENTS

| | | | | |
|---|---|---|---|---|
| 2008/0302691 | A1* | 12/2008 | Olson | B65D 5/48026 206/427 |
| 2013/0048531 | A1* | 2/2013 | Nicoletti | A61M 5/002 206/557 |
| 2013/0277267 | A1* | 10/2013 | Valiulis | B65D 19/38 206/597 |
| 2019/0100347 | A1* | 4/2019 | Carrier | B65D 5/5045 |

OTHER PUBLICATIONS

European Search Report dated Jan. 22, 2020 for European Application No. 19 18 9116 (4 pages).
European Office Action dated Feb. 21, 2020 for European Application No. 19 18 9116 (9 pages).
European Communication Pursuant to Article 94(3) EPC dated Oct. 30, 2020 for European Patent Application No. 19 189 116.7 (5 pages).

* cited by examiner

TRANSPORT PACKAGING FOR CONTAINERS AND METHOD OF UNPACKING CONTAINERS

CROSS REFERENCE TO RELATED APPLICATIONS

This application claims priority to European Patent Application No. 19189116.7 filed on Jul. 30, 2019, which is incorporated in its entirety herein by reference.

BACKGROUND OF THE INVENTION

1. Field of the Invention

The present invention relates to a transport packaging for packing a plurality of containers, in particular glass containers and a method of unpacking a plurality of containers packaged in a transport packaging. Furthermore, the invention relates to a suitable unpacking device.

2. Description of the Related Art

The mechanical stability of a glass container depends very much on its history of handling during its life cycle. Glass-to-glass contact, particularly during transportation, can induce defects such as scratches and chips into the glass and can reduce the mechanical strength of the glass and diminish the cosmetic integrity. For certain applications, such as chemical tempering of glass, it is critical that defects are not introduced into the glass prior to treatment.

Ready-to-use (RTU) packaging of nested containers such as syringes, vials and cartridges have made pharmaceutical manufacturing lines more efficient, lowered total cost of ownership (TCO), and added flexibility in fill and finish operations. RTU products are supplied in a standard tub and nest configuration (bulk ware) and can be compatible with existing filling lines or new flex filling lines, allowing manufacturers to fill multiple forms of packaging without the burden of changing equipment. Typically, in these standard manufacturing lines, containers are placed such that they are directly adjacent to each other and/or even in mutual contact.

However, before processing RTU containers, they are transported in bulk and that can cause a quality issue for RTU products. In particular, during transport, due to glass-to-glass contact and friction, bulk packaged containers can be scratched or damaged.

With respect to 'white-ring' defects, the applicant has performed thorough transport simulation studies to confirm the root cause of these defects. The goal of this transport simulation was to determine if transportation is, in fact, the cause of the white-ring defects. To this end, containers were tested in standard bulk packaging AKYLUX® boxes. The boxes were arranged in a pallet configuration with alternate layer stacking and 18 Boxes per layer. Then, transportation simulation testing was performed according to ASTM D4169-16 DC 13 AL 2 Standard Practice for Performance Testing of Shipping Containers and Systems. Truck- and air-spectrum vibration profiles were chosen. The results of the testing confirm that the 'white ring' defects arise on containers packed in standard bulk packaging due to transportation.

SUMMARY OF THE INVENTION

In some exemplary embodiments provided according to the present invention, a transport packaging includes a tray formation which is configured to hold a plurality of containers with mutual separation to avoid mutual contact of the containers. The tray formation includes a first tray part having a plurality of pockets configured to receive first ends of the containers and a second tray part removably coupled to the first tray part and having a corresponding plurality of pockets configured to receive second ends of the containers. The first tray part is formed such that, when the second tray part is removed so that the second ends of the containers are free from the pockets of the second tray part, the free second ends of the containers are free to be brought into mutual contact while the first ends of the containers are still received in the pockets of the first tray part.

In some exemplary embodiments provided according to the present invention, a method of unpacking a plurality of containers packaged in a transport packaging is provided. The transport packaging includes a tray formation with a first tray part and a second tray part, the first tray part having a plurality of pockets receiving first ends of the containers and the second tray part having a corresponding plurality of pockets receiving second ends of the containers. The method includes: removing the second tray part from the containers such that the second ends of the containers are free from the pockets of the second tray part; bringing the free second ends of the containers into mutual contact while the first ends of the containers are still received in the pockets of the first tray part; and removing the first tray part from the containers while the second ends of the containers are still kept in mutual contact, the first tray part being removed such that, during its removal, the first ends of the containers gradually approach each other, until, when the first tray part is completely removed, the first ends come into mutual contact.

In some exemplary embodiments provided according to the present invention, a tray formation for holding a plurality of containers includes a first tray part having a plurality of pockets configured to receive first ends of the containers and a second tray part having a corresponding plurality of pockets configured to receive second ends of the containers. The first tray part and the second tray part are configured to hold containers having at least one of a first end forming a shoulder merging into a crimp neck or a second end forming a bottom, or vice versa. The first tray part is identical to the second tray part such that the pockets of both the first tray part and the second tray part have a side wall defining a larger diameter configured to accommodate or laterally secure either the shoulder of the container or the bottom of the container and another side wall defining a smaller diameter configured to accommodate or laterally secure the crimp neck of the container.

In some exemplary embodiments provided according to the present invention, a package includes: a tray formation including a first tray part having a plurality of first pockets and a second tray part removably coupled to the first tray part and having a corresponding plurality of second pockets that are each aligned with a respective one of the first pockets to form a container holder; and a plurality of containers each held in a respective container holder in mutual separation from one another, each of the containers having a first end held in a respective one of the first pockets and a second end held in a respective one of the second pockets. The first tray part is configured such that, when the second tray part is removed so that the second ends of the held containers are free from the pockets of the second tray part, the free second ends of the held containers are free to be brought into mutual contact while the first ends of the held containers are still received in the pockets of the first tray part.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein:

FIG. 15 is a three-dimensional view of a tray formation with two identical tray parts holding containers in between;

FIG. 16 is a sectional view of a tray formation with two identical tray parts holding containers in between;

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1A:
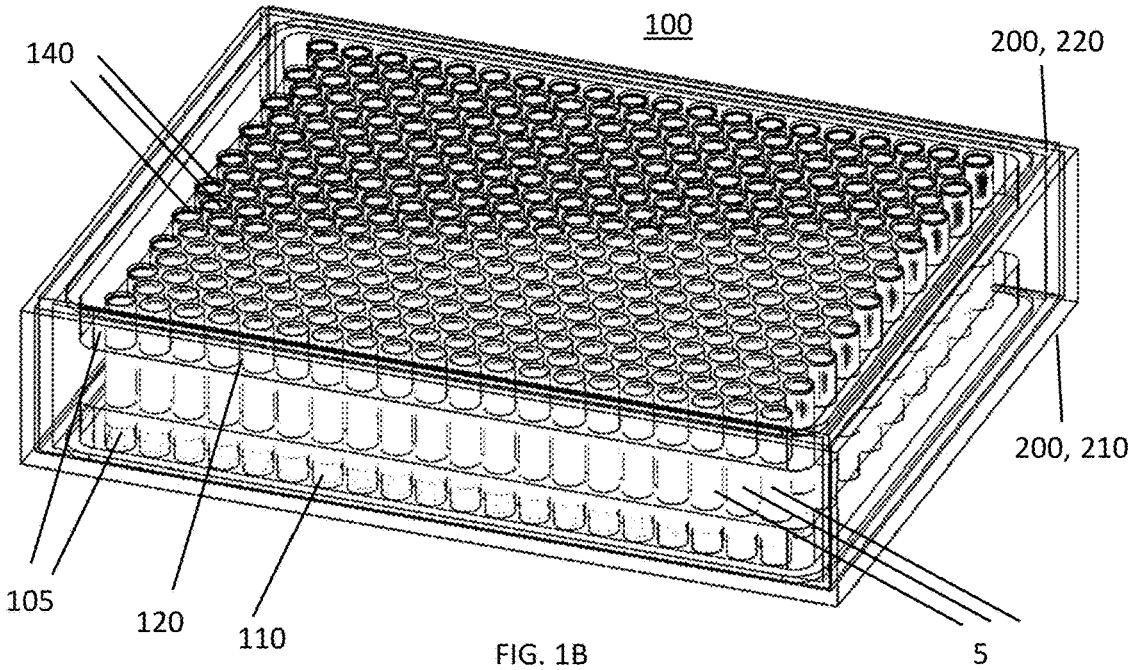
FIG. 1A is a three-dimensional view of a transport packaging holding a plurality of containers and comprising an outer box and a tray formation with first and second tray parts inserted in the outer box.

Exemplary embodiments provided according to the invention provide a solution for transport packaging of containers such as syringes, vials and cartridges, which is compatible with standard manufacturing lines, in particular line systems for RTU packaging, but prevents the formation of scratches, defects or damages during transportation, such as 'white-ring' defects on the outside of glass containers. An aspect is to bring containers in a good condition to the wash-line so they can be further processed for RTU products.

Exemplary embodiments disclosed herein provide a transport packaging for packing a plurality of containers in an arrangement with mutual separation and for unpacking the plurality of containers in an arrangement with mutual contact, in particular for glass containers for substances for pharmaceutical, medical or cosmetic applications.

The transport packaging comprises a tray formation which is configured to hold the plurality of containers with mutual separation to avoid mutual contact of the containers, in particular glass-to-glass contact. The tray formation comprises a first tray part and a second tray part, the first tray part having a plurality of pockets for receiving first ends of the containers, and the second tray part having a corresponding plurality of pockets for receiving second ends of the containers.

In other words, the product comprises a tray formation with two tray inserts which can be used along with the standard bulk packaging to provide separation between individual cartridges. In the final configuration, each cartridge is held in its own 'pocket' made up of the upper insert which encapsulates the cartridge crimp and shoulder end and the lower insert which encapsulates the glazing end. The cartridge can be encapsulated, for example, at the two widest points and/or fixed in place and/or held so that each cartridge is separated by a minimum distance from its neighbor, such there is no glass-to-glass contact during transportation.

According to the invention, the first tray part of the tray formation is formed such that, when the second tray part of the tray formation is removed (so that the second ends of the containers are free from the pockets of the second tray part) these free second ends of the containers can be brought into mutual contact while the first ends of the containers are still received in the pockets of the first tray part.

In some embodiments, the first tray part is further formed such that, when the second tray part is removed and the free second ends of the containers are brought into mutual contact, the first tray part can be removed such that, during its removal, the first ends of the containers gradually approach each other, until, when the first tray part is completely removed, they come into mutual contact, in particular without damaging the containers.

The invention thus provides a solution for glass-to-glass contact-free packaging that allows damage-free transportation of bulk ware, in particular between production sites. At the same time, the solution can be used with the current standard packaging and line systems which require the containers to be positioned in tight grouping.

The design is compatible with various container and/or cartridge formats and the same tray can be compatible with more than one cartridge volume, i.e. the container and/or cartridge lengths can be different between two cartridges with the same outer diameter. In this way, the packaging solution can be used with containers and/or cartridges.

With respect to the previously described simulation study, transport simulations have again been performed on more than 8500 units to confirm that, with the packaging solution provided according to the invention, defects, in particular 'white rings', are no longer occurring. To this end, cartridges 5 packed in glass-to-glass contact-free packaging were again imaged before transportation simulation and after the transportation simulation testing.

In addition to visual inspection, a total of 600 container (cartridge) units were examined under a magnifying system:

150 packed in standard packaging and located in the center of the pallet layer, 150 packed in standard packaging and located at the edge of the pallet layer, 150 packed in the package provided according to the invention and located in the center of the pallet layer and 150 packed in the package provided according to the invention and located at the edge of the pallet layer. While a 'white ring' defect was confirmed present in 100% of units packed in standard packaging, such defects were confirmed absent in 100% of units packed in the package provided according to the invention. Results thus confirm that bulk ware can be transported without damage.

In some embodiments, the pockets of the first tray part have a side wall for laterally securing the first ends of the containers, and the side wall for laterally securing the first ends of the containers are inclined with respect to the longitudinal axis of the containers such as to facilitate that the free second ends of the containers can be brought into mutual contact (when the second tray part of the tray formation is removed) and/or that the first ends of the containers gradually approach each other until they come into mutual contact (when the first tray part is gradually removed until complete removal).

In some embodiments, the angle of inclination between a side wall for laterally securing the containers and a container longitudinal axis is in the range of 2° to 8°, such as in the range of 2° to 7°, in the range of 2° to 6°, in the range of 3° to 5°, or in the range of 3° to 4°.

In some embodiments, the pockets of the first tray part are arranged in a regular grid such that, for a specific (given) pocket, each of the adjacent pockets (usually six) is spaced apart with the same spacing to the specific (given) pocket, such as to facilitate that the free second ends of the containers can be brought into mutual contact (when the second tray part of the tray formation is removed) and/or that the first ends of the containers gradually approach each other until they come into mutual contact (when the first tray part is gradually removed until complete removal).

In some embodiments, the spacing between a specific pocket and its adjacent pockets (usually six) is in the range of 0.25 mm to 2 mm, such as in the range of 0.3 mm to 1.5 mm or in the range of 0.5 mm to 1 mm. The spacing can be formed as an elevation in between the pockets.

In principle, the transport packaging provided according to the present invention can be made for various numbers of containers, and correspondingly with trays with various numbers of pockets. The plurality of pockets of the first tray part may comprise at least 10 pockets, such as at least 100 pockets, at least 200 pockets, at least 300 pockets, or at least 350 pockets.

The tray parts may be formed of a thin sheet of plastic, e.g. by a shaping process. The thickness of the sheet and/or of the formed tray parts may be in the range of 0.6 mm to 1 mm, such as in the range of 0.7 mm to 0.9 mm or in the range of 0.6 mm to 0.8 mm. Such thicknesses may allow for slight bending of the tray parts, which facilitates that the free second ends of the containers can be brought into mutual contact (when the second tray part of the tray formation is removed) and/or that the first ends of the containers gradually approach each other until they come into mutual contact (when the first tray part is gradually removed until complete removal).

As mentioned previously, exemplary embodiments provided according to the invention may be used for containers such as, for example, syringes, vials and cartridges, without being limited to those types of containers. Independent of the specific type of container, an exemplary embodiment provided according to the invention relates to containers having one end forming a shoulder merging into a neck portion and/or another end forming a closed or open bottom portion. In other words, the first and second tray parts may be configured to hold containers having a first end forming a shoulder merging into a neck, e.g. a crimp neck, and/or a second end forming a bottom. The terms "first" and "second" may be used vice versa.

To hold those containers, the pockets of the first tray part may have one side wall defining a larger diameter for accommodating or laterally securing the shoulder of the container and another side wall defining a smaller diameter for accommodating or laterally securing the neck of the container. In addition or alternatively, the pockets of the second tray part may have one side wall for laterally securing the bottom of the container. Again, the terms "first" and "second" may be used vice versa.

In some embodiments, the first and second tray parts are identical, such that the pockets of both the first and the second tray parts have one side wall defining a larger diameter for accommodating or laterally securing either the shoulder of the container or the bottom of the container and another side wall defining a smaller diameter for accommodating or laterally securing the crimp neck of the container (or being empty). By using identical tray parts, the processing can be simplified and costs can be reduced.

The transport packaging as described may, in addition, comprise an outer box for inserting the tray formation. In other words, the two tray parts (and containers) can be packed in this outer box, which may, for example, be a standard AKYLUX® Box. The outer box may have a lower base and upper lid which secure the full setup.

As has been described, the first tray part may be formed such that, when the second tray part is absent but the containers are still received in the pockets of the first tray part, the free ends of the containers can be brought into mutual contact. In particular, this mutual contact can be evoked by compressing the plurality of containers from the outside, such that at least some of the containers are received tilted in the first tray part's pockets.

In order to compress the container arrangement on the side of their free ends, exemplary embodiments provided according to the invention further provide an unpacking device. This unpacking device is designed for unpacking a plurality of containers, in particular glass containers for substances for pharmaceutical, medical or cosmetic applications, in particular for unpacking the containers from a transport packaging as has been described above.

The unpacking device defines an inner cavity for receiving the containers in an arrangement with mutual separation and for conveying the containers into an arrangement with mutual contact.

In some embodiments, the unpacking device comprises at least two corner parts defining an inner cavity. The at least two corner parts can be moved apart to increase the inner cavity, in particular to put the device over the free ends of the containers and bring them into mutual contact by reverting the corner parts to their original configuration with decreased inner cavity. In some embodiments, the at least two corner parts can be moved apart elastically and reverted back elastically. To this end, the unpacking device may comprise an elastic rubber band enclosing the at least two corner parts.

In some embodiments, the unpacking device comprises four corner parts defining the inner cavity. The four corner parts can be moved apart slidably and reverted back slidably. To this end, two adjacent corner parts, in particular each two adjacent corner parts, may be slidably attached to each other, in particular such that a finger member of one corner part is slidably received in a guiding channel of the adjacent corner part.

In some embodiments, the inner cavity of the unpacking device is formed by a funnel, the funnel comprising a larger end for receiving the containers in an arrangement with mutual separation, and a smaller end for releasing the containers in an arrangement with mutual contact. The larger end of the funnel may be formed as a larger rectangular section, and the smaller end of the funnel may be formed as a smaller rectangular section. The smaller rectangular section may, for example, be centered with respect to the larger rectangular section. In another example, the smaller rectangular section may be laterally offset with respect to the larger rectangular section, in particular such that at least one side of both rectangular sections is congruent.

The invention further relates to a method for unpacking a plurality of containers packaged in a transport packaging, in particular as describe above. The transport packaging comprises a tray formation with a first tray part and a second tray part, the first tray part having a plurality of pockets receiving first ends of the containers, and the second tray part having a corresponding plurality of pockets receiving second ends of the containers. The method of unpacking may comprise the following steps: (a) the second tray part is removed from the containers such that the second ends of the containers are free from the pockets; (b) the free second ends of the containers are brought into mutual contact, while the first ends of the containers are still received in the pockets of the first tray part; and (c) the first tray part is removed from the containers while the second ends of the containers are still kept in mutual contact. The first tray part is removed such that, during its removal, the first ends of the containers gradually approach each other, until, when the first tray part is completely removed, they come into mutual contact, in particular without damaging the containers.

In some embodiments, the free second ends of the containers are brought into mutual contact and/or are kept in mutual contact by an unpacking device, as described previously.

In an exemplary process sequence, after the free second ends of the containers are brought into mutual contact, the first tray part and the containers are turned around (by 180 degrees), in particular by a turning plate. To this end, the turning plate may be placed on the (tilted) second ends of the containers, then the turning plate and the first tray part can be turned around such the containers in between are turned around as well.

The invention is further directed to a tray formation for holding a plurality of containers with mutual separation to avoid mutual contact of the containers, in particular for a transport packaging as described previously or according to a tray formation of a transport packaging as described previously.

The tray formation comprises a first tray part and a second tray part, the first tray part having a plurality of pockets for receiving first ends of the containers, and the second tray part having a corresponding plurality of pockets for receiving second ends of the containers. The first and second tray parts are configured to hold containers having a first end forming a shoulder merging into a neck and/or a second end forming a bottom, or vice versa.

The first and second tray parts are identical, such that the pockets of both the first and the second tray parts have a side wall defining a larger diameter for accommodating or laterally securing either the shoulder of the container or the bottom of the container and another side wall defining a smaller diameter for accommodating or laterally securing the neck of the container.

Figure 1B:
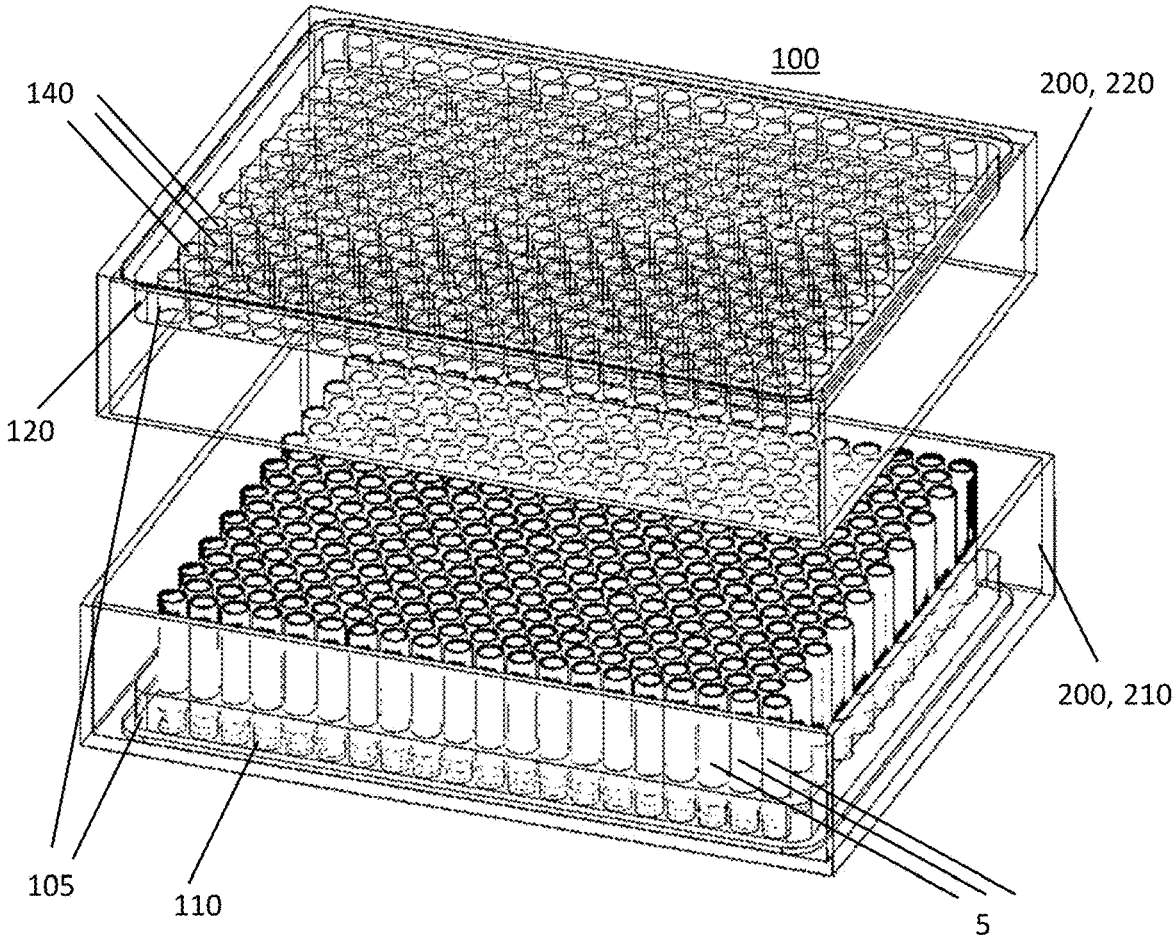
FIG. 1B is a three-dimensional view of the transport packaging of FIG. 1A with the base and the lid of the outer box separated.

Referring now to the drawings, the transport packaging 100 illustrated in FIG. 1A comprises a tray formation 105 consisting of two tray parts 110 and 120 for holding a plurality of containers 5 in a plurality of pockets 140 in the tray parts, such that the containers 5 are spaced apart from each other, i.e., are not in contact. The tray parts 110 and 120, which are identical in this case, are inserted in a standard packaging box 200, such as an AKYLUX® Box, comprising a base 210 and a lid 220. The tray parts 110, 120 only enclose the container ends, such that, when the containers 5 are held by the tray formation 105, the tray parts 110, 120 are separated from one another. As is better seen in FIG. 1B, the lower tray part 110 is inserted in the box base 210, while the upper tray part is inserted in the box lid 120.

Figure 2:
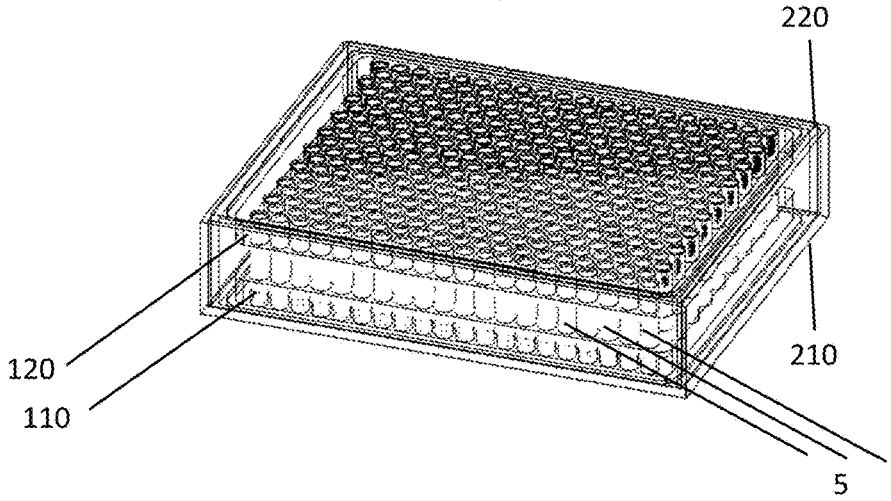
FIGS. 2-13 are three-dimensional views illustrating a method of unpacking the plurality of containers packaged in the transport packaging of FIGS. 1A and 1B.
Figure 3:
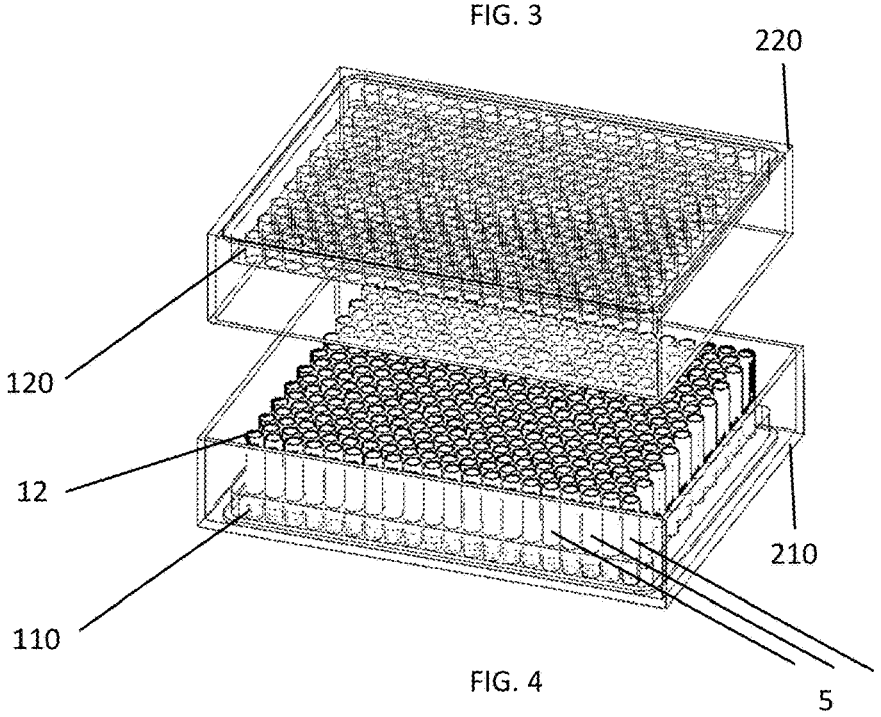
Figure 4:
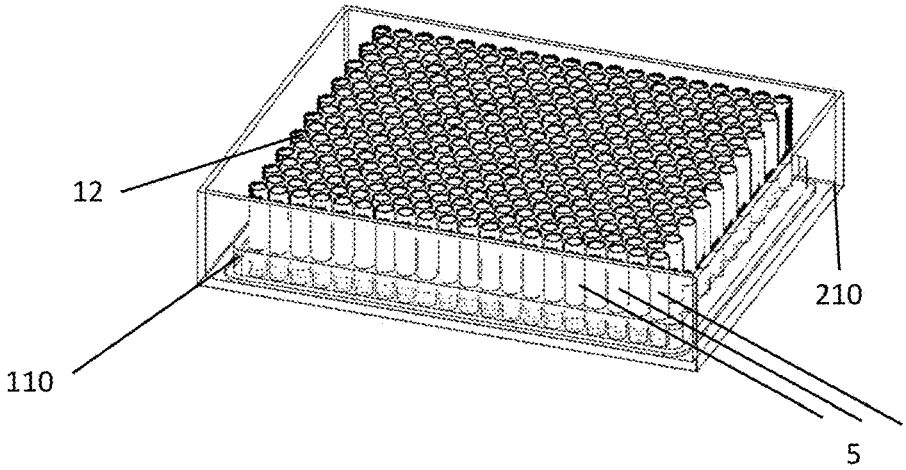

With respect to FIGS. 2-10, an exemplary process for unpacking containers 5 from a transport packaging 100 will be explained. Such a process may, in particular, be a manual-handling process to unpack glass-contact-free-transported cartridges on standard washlines. As seen in FIG. 2, which is similar to FIG. 1A, the containers 5 are initially held in between the first and second tray inserts 110, 120 which in turn, in this case, are enclosed by the lower and upper transport box parts 210, 200 (base and lid) which are plugged together. Referring to FIG. 3, the second tray part 120 is removed from the second container ends 12. To this end, in this case, the second box part 220 which accommodates and holds the second tray part 120 is removed. As a result, the containers 5 are only held by the pockets of the first tray part 110, which, in this case, is inserted in the first box part 210. As seen in FIG. 4, the second ends 12 of the containers 5 are now free from the pockets 140 of the second tray part, which has been removed. Nevertheless, the containers 5 and their second ends 12 are still spaced apart with respect to each other, due to the spacing of the pockets 140 of the first tray part 110 which are holding the containers 5.

Figure 5:
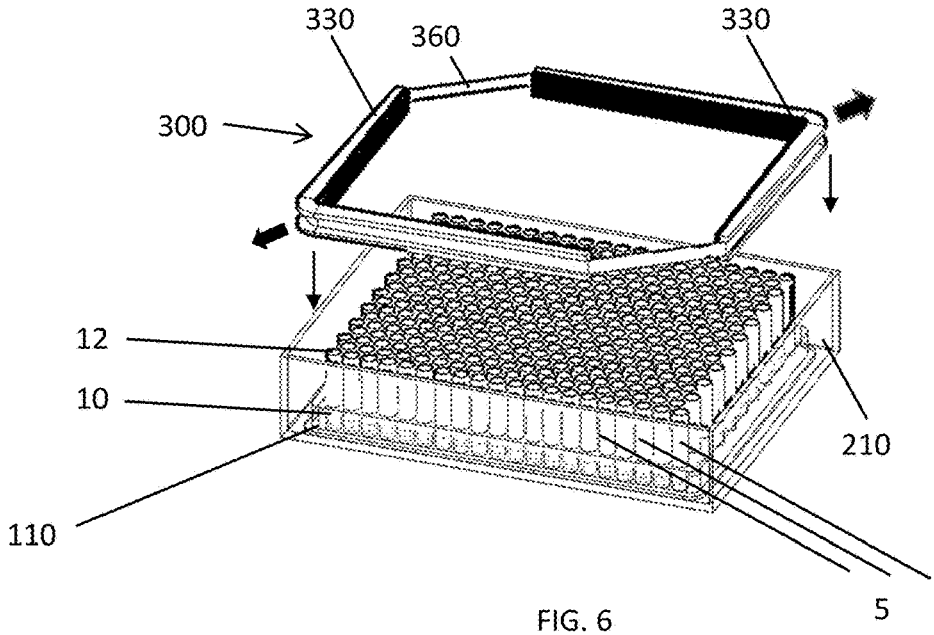
Figure 6:
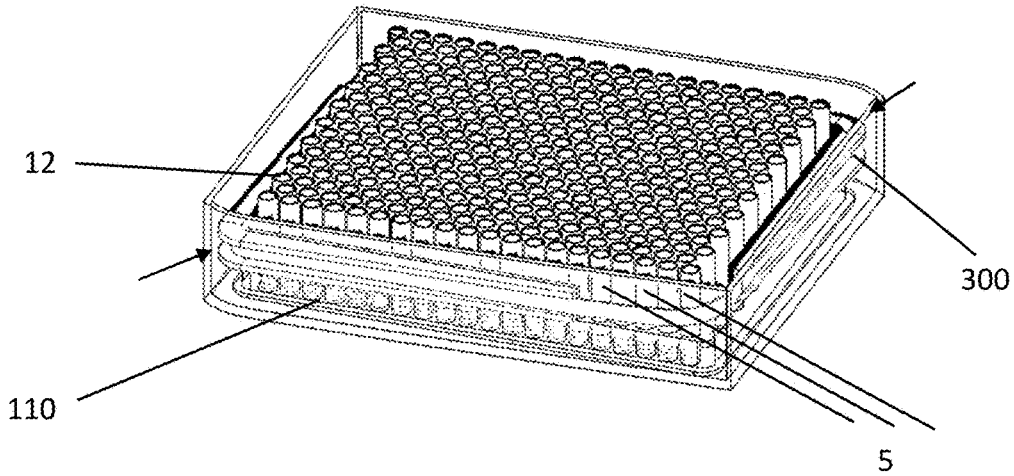
Figure 7:
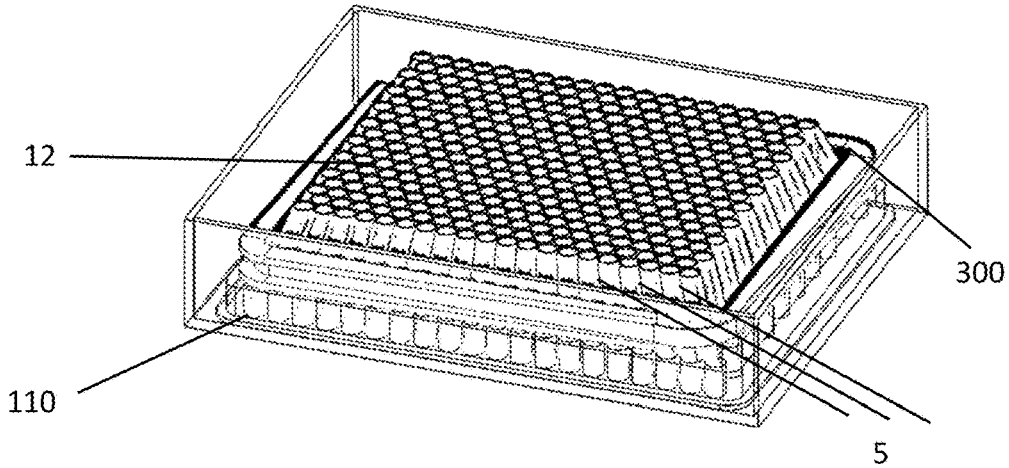

With respect to FIGS. 5-7, the free second ends 12 of the containers 5 are now brought into mutual contact, while the first ends 10 of the containers 5 are still received in the pockets 140 of the first tray part 110. To this end, an unpacking device 300, which may also be referred to as an alignment frame, 300 is used. The unpacking device 300, which comprises two corner elements 330 which are hold together by an elastic band 360, is elastically expanded by pulling the corner elements 360 apart from each other. Thereby, the inner cavity in between the corner elements 330 is increased such that the unpacking device 300 is in an expanded (open) state in which it can be wrapped around the plurality of containers 5 as a whole, as is seen in FIG. 6. By letting the unpacking device 300 elastically contract back into its contracted (closed) state, the free container ends 12, which are spaced apart from each other, are moved towards each other, thereby eliminating the spacing in between them, such that they are brought into mutual contact. FIG. 7 shows the situation, in which the second ends 12 of the containers 5 are in mutual contact, while the first ends 10 are still hold and spaced apart by the first tray part 110 such that at least some of containers 5 are tilted. This is facilitated by the form of the first tray part 110 and/or its pockets 140, as will be explained in more detail further herein.

Figure 8:
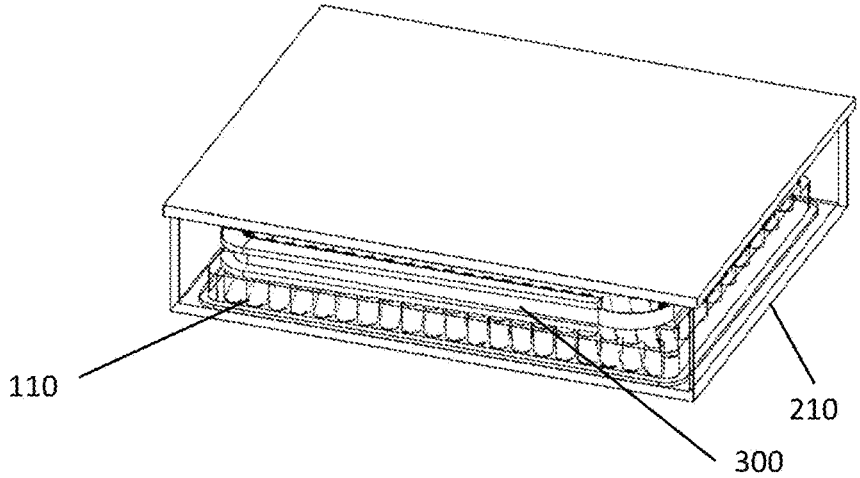
Figure 9:
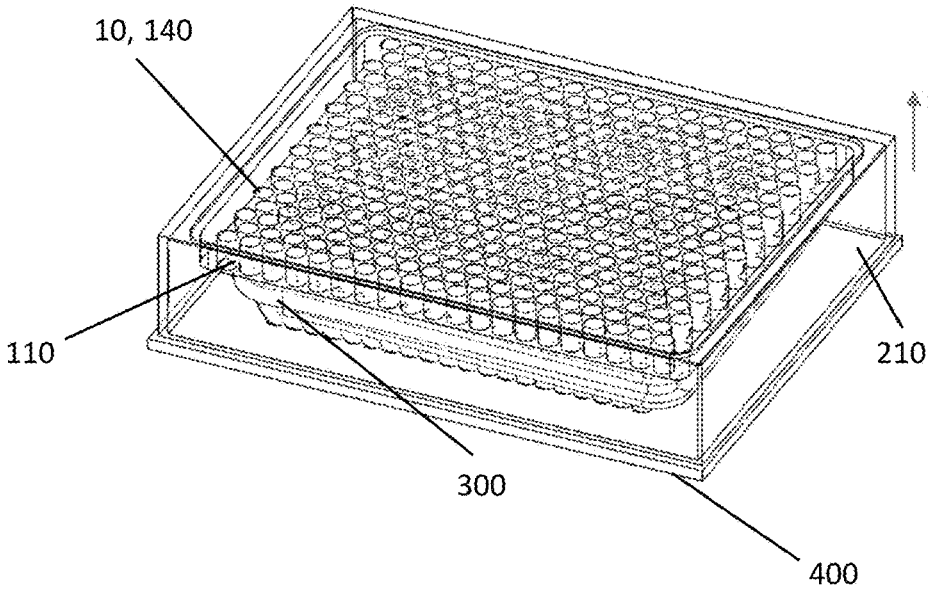

In FIGS. 8 and 9 it is shown that the containers 5 are turned around by a turning plate 400 which, in this case, is placed on box base part 210 accommodating the first tray part 110 holding the containers 5. Thereby, the turning plate 400 is placed upon the second container ends 12 which are still tightened by the contracted unpacking device 300. As shown in FIG. 9, the containers 5 are turned around (by 180 degrees) by turning around the turning plate 400 together with the first tray part 110 and/or the first box part 210.

Figure 10:
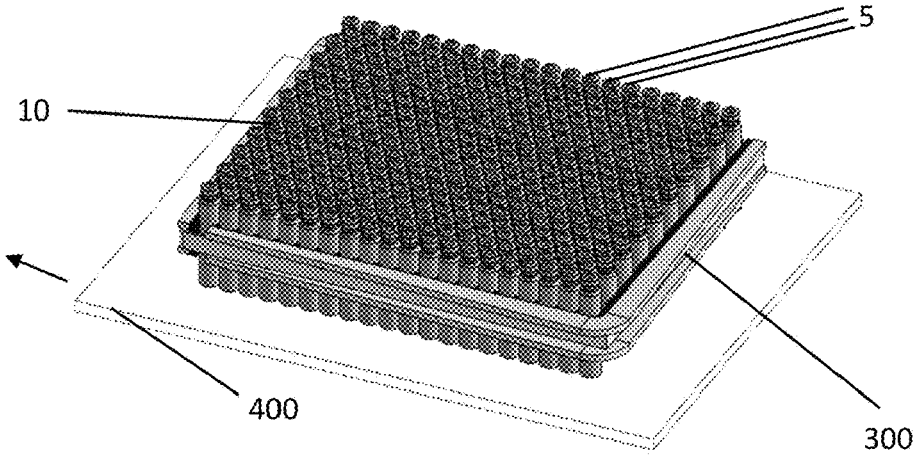
Figure 11:
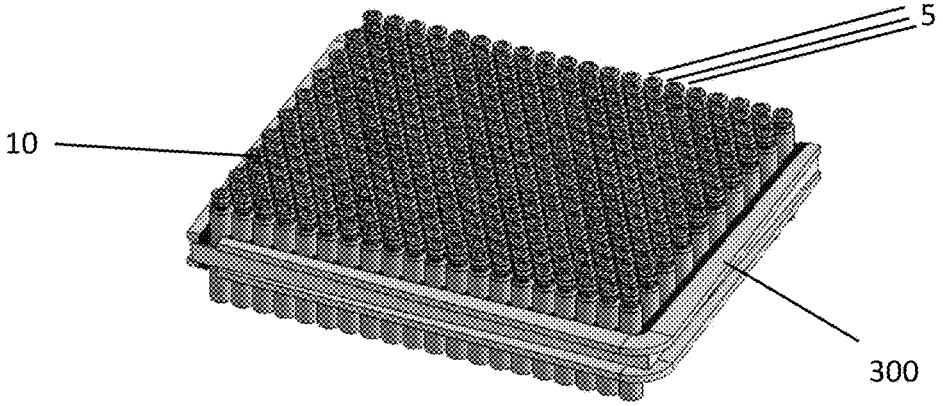
Figure 12:
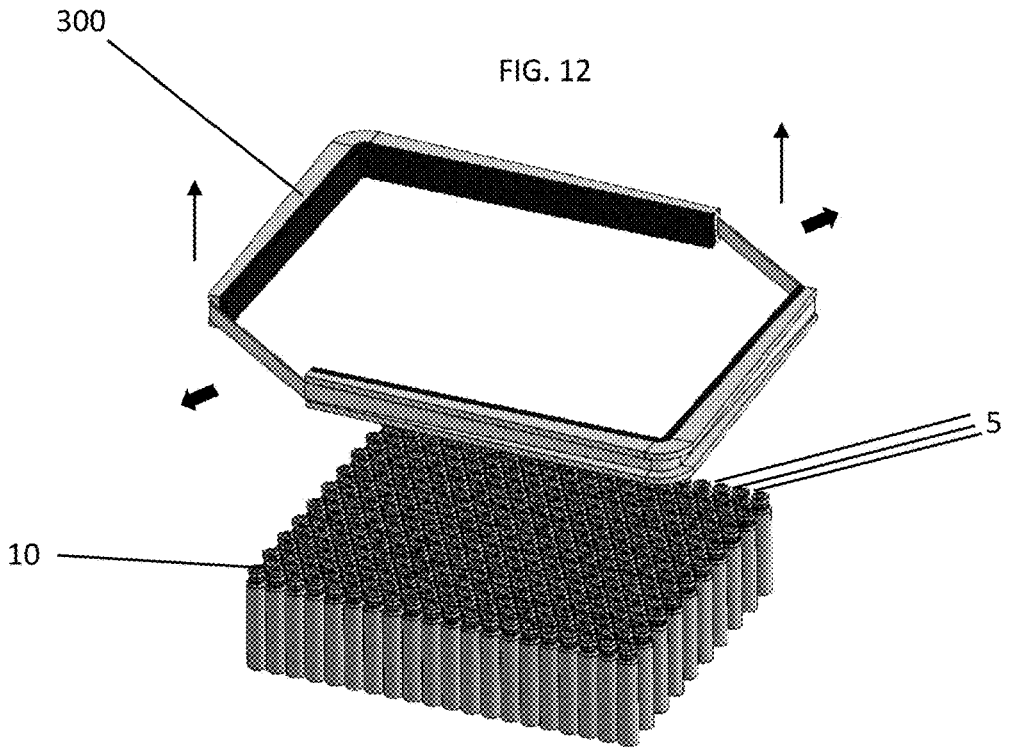
Figure 13:
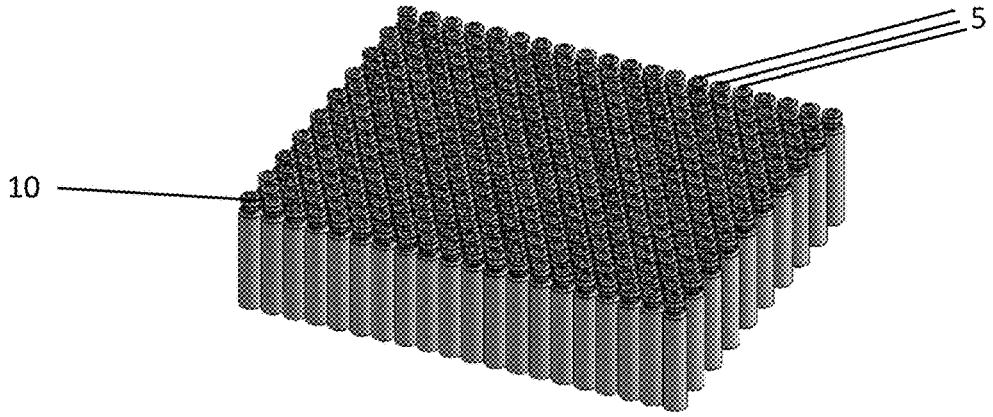

Now, the first tray part 110 is removed from the first ends 10 of the containers 5. The first tray part 110 and/or the pockets 140 of the first tray part 110, which hold the first container ends 10 at a specified distance, are configured such that during removal of the first tray part 110 the first ends 10 of the containers 5 gradually approach each other, until, when the first tray part 110 is completely removed, they come into mutual contact. Removing the first tray part 110, in particular in a slow manner, while the unpacking device 300 is contracted onto the containers 5, therefore allows for gradually bringing the containers 5 into full contact at both ends 10, 12, as is depicted in FIG. 10. Thus, the plurality of containers 5 is arranged such as to be compatible with standard manufacturing lines, in particular line systems for RTU packaging. The turning plate 400, which is now below the containers 5, can be removed. With respect to FIG. 11-13, the unpacking device 300 can be removed by expanding it again to its open state.

Figure 14A:
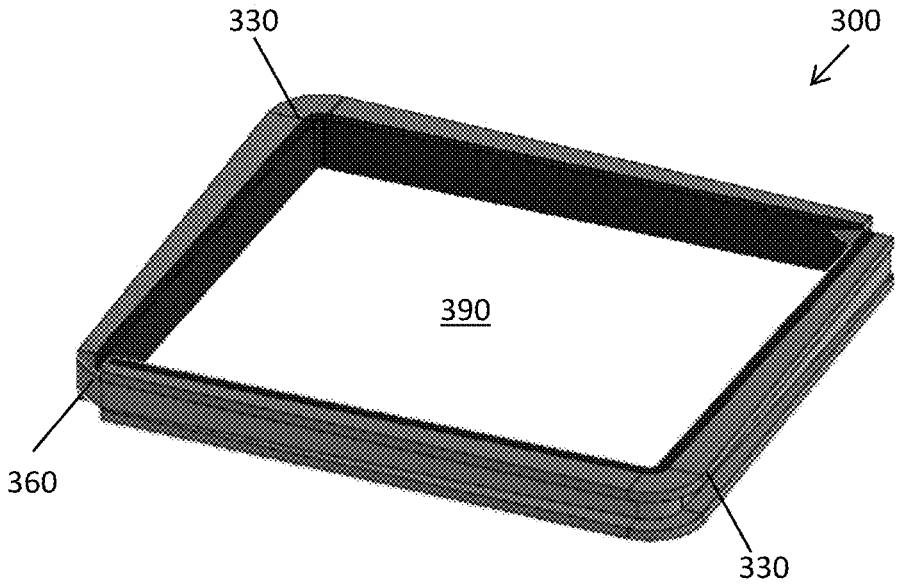
FIG. 14A is a three-dimensional view of an unpacking device in a contracted configuration.
Figure 14B:
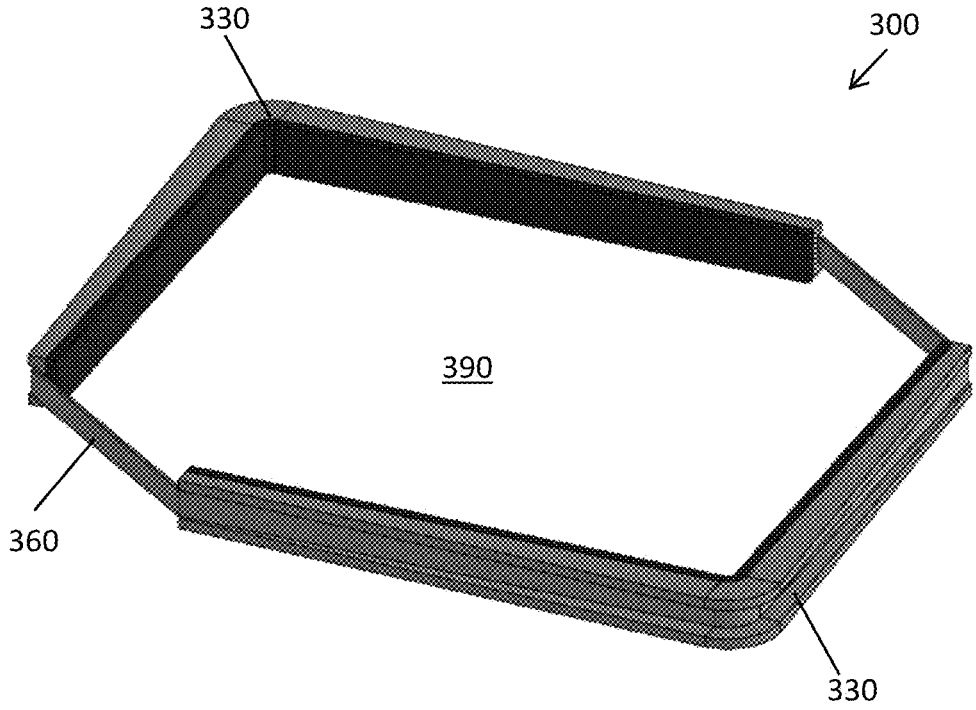
FIG. 14B is a three-dimensional view of an unpacking device in an expanded configuration.

FIGS. 14A and 14B again show the unpacking device 300 for unpacking a plurality of containers 5. The unpacking device 300 comprises two corner parts 330 surrounded by an elastic element 360 defining an inner cavity 390 for receiving the plurality of containers 5. The two corner parts 300 can be elastically moved apart to an open configuration (FIG. 14B) in which the inner cavity 390 is increased such that the whole plurality of containers 5 in their separated arrangement fits therein. By elastically reverting the unpacking device 300 back to its closed configuration (FIG. 14A), the plurality of containers 5 can be brought into mutual contact.

Figure 14C:
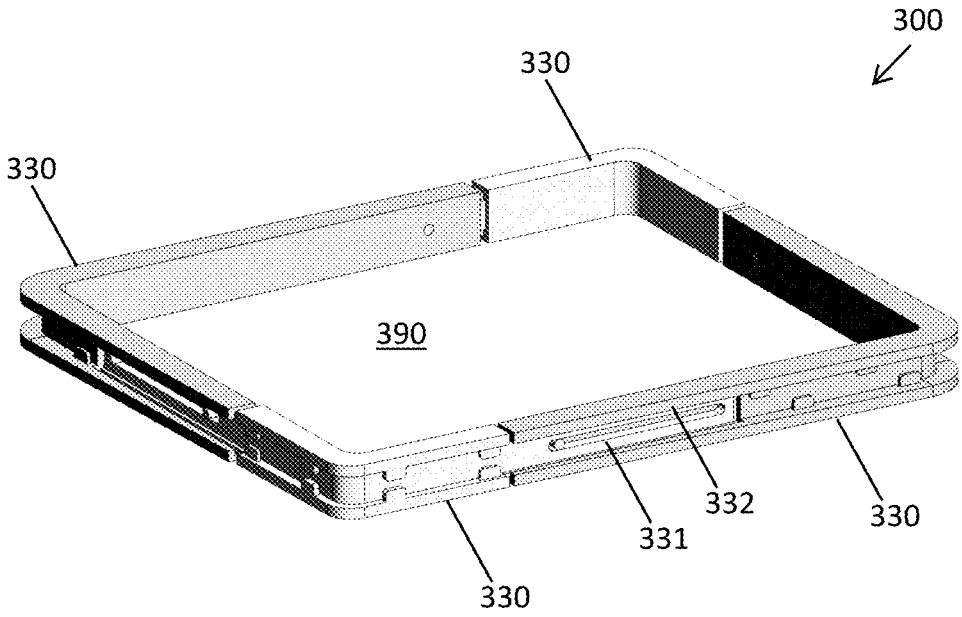
FIG. 14C is a three-dimensional view of another exemplary embodiment of an unpacking device in a contracted configuration.
Figure 14D:
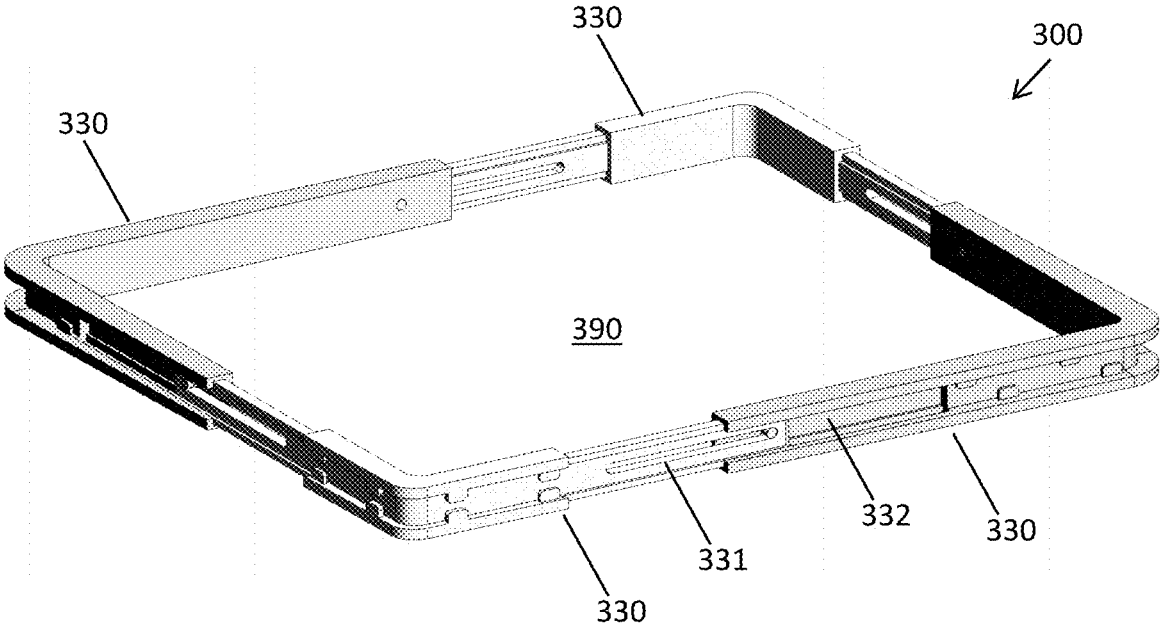
FIG. 14D is a three-dimensional view of the unpacking device of FIG. 14C in an expanded configuration.
Figure 14E:
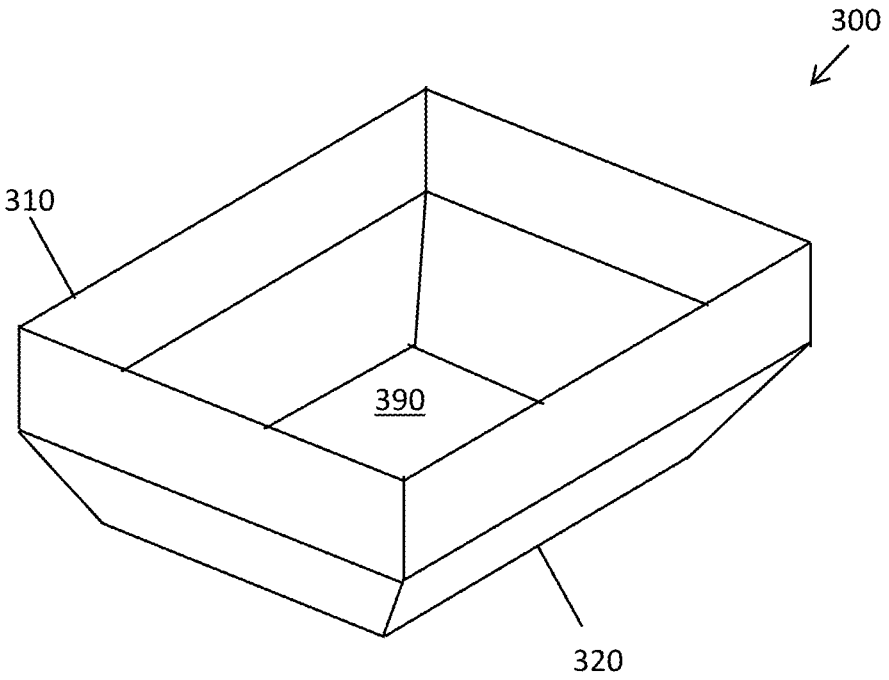
FIG. 14E is a three-dimensional view of a funnel unpacking device.
Figure 14F:
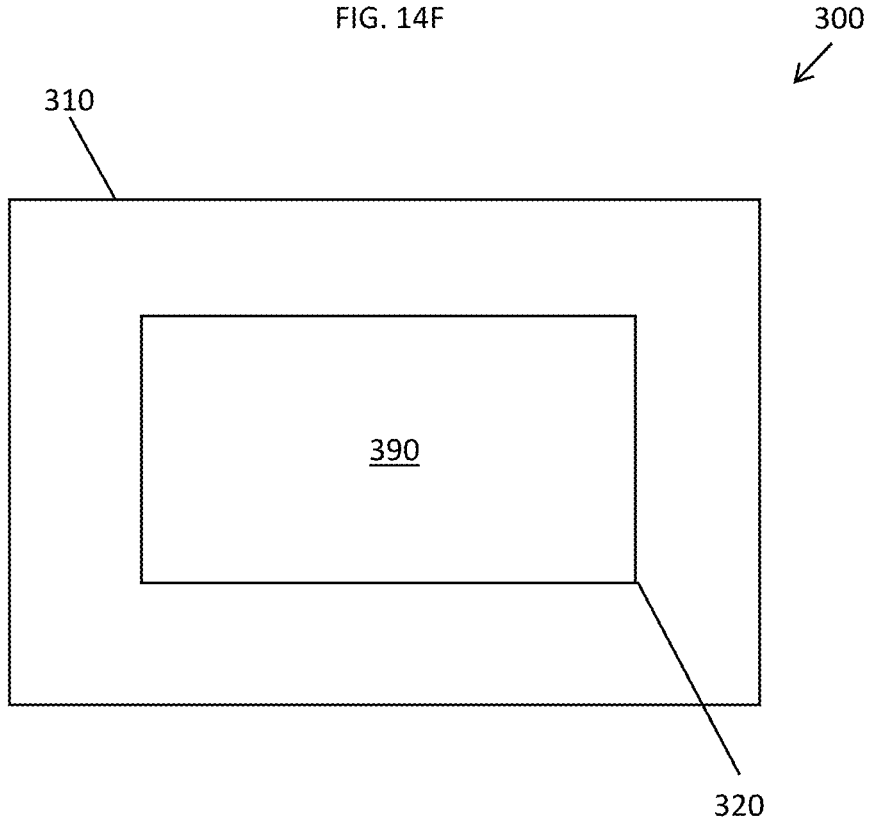
FIG. 14F is a two-dimensional top view of the funnel unpacking device of FIG. 14E.

FIGS. 14C and 14D show another unpacking device 300 for unpacking a plurality of containers 5 which comprises four corner parts 330, with adjacent corner parts being slidably attached to each other by a finger member 331 being received in a guiding channel 332 of the adjacent corner part. Thus, the four corner parts 330 can be moved apart to an open configuration (FIG. 14D) and reverted back to a closed configuration (FIG. 14C).

Figure 14G:
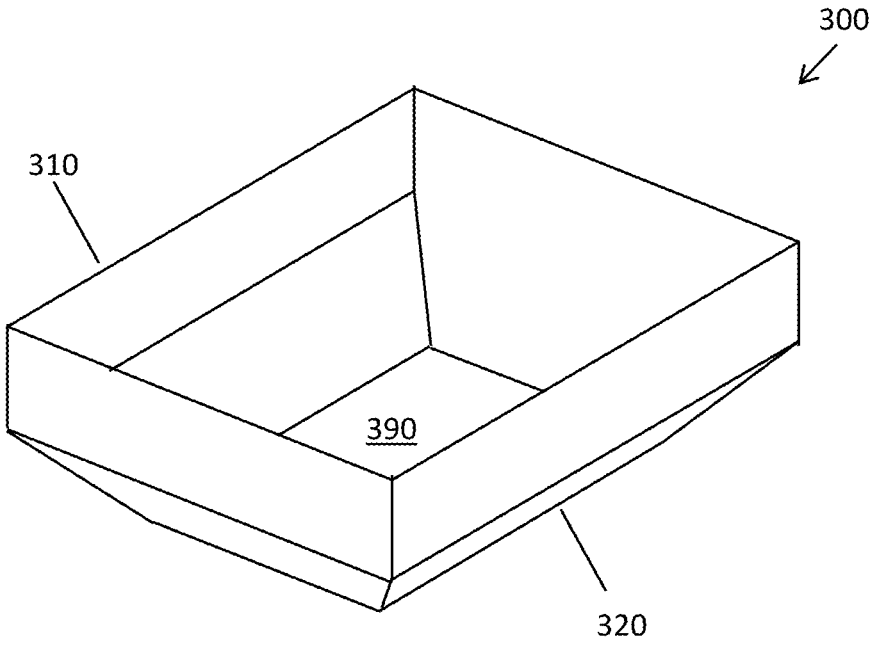
FIG. 14G is a three-dimensional view of another exemplary embodiment of a funnel unpacking device.
Figure 14H:
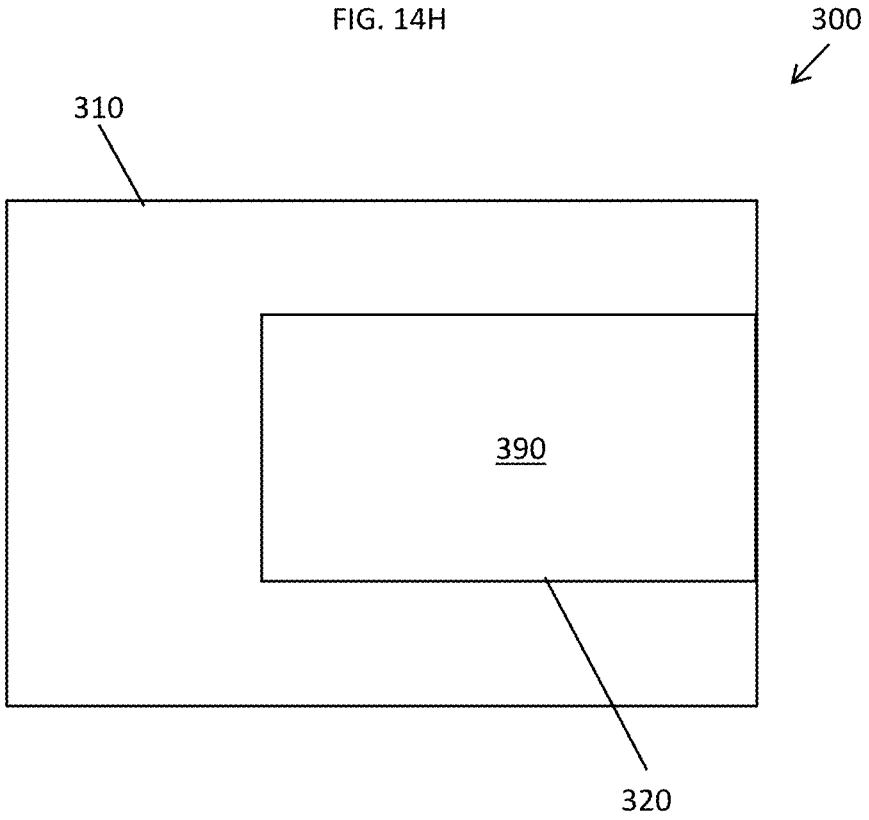
FIG. 14H is a two-dimensional top view of the funnel unpacking device of FIG. 14G.

FIGS. 14E and 14F and FIGS. 14G and 14H show further unpacking devices 300, which are based on a funnel concept. In both cases, the funnel defines the inner cavity 390 of the unpacking device 300. The funnel has a larger end 310 for receiving the containers in an arrangement with mutual separation and a smaller end 320 for releasing the containers in an arrangement with mutual contact. The unpacking devices 300 are both of rectangular shape; that is, the larger end of the funnel is formed as a larger rectangular section and the smaller end of the funnel is formed as a smaller rectangular section. With respect to the unpacking device 300 shown in FIGS. 14E and 14F, the smaller end 320 is centered with respect to the larger end 310. FIGS. 14G and 14H, on the other hand, show an unpacking device 300 where the smaller end 320 is laterally offset with respect to the larger end 310.

Figure 15:
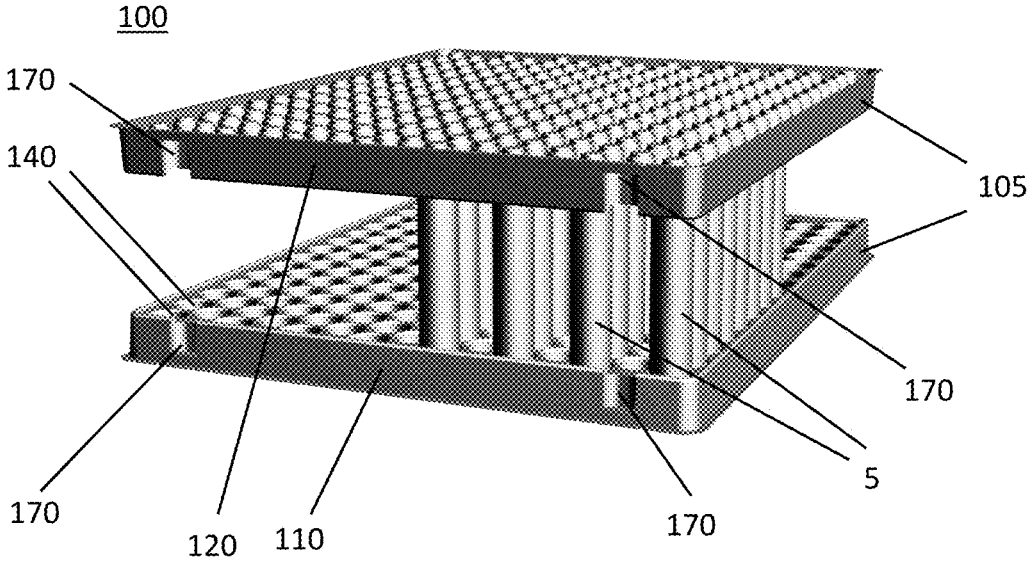
Figure 16:
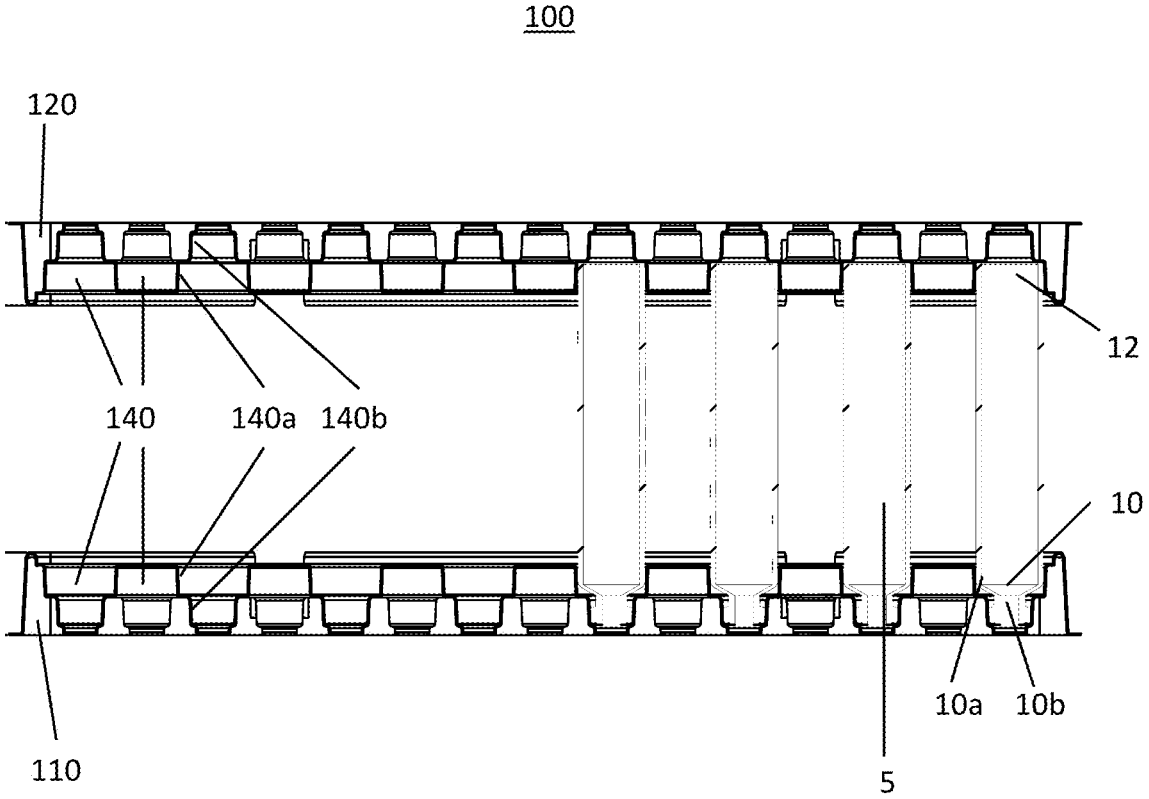

FIGS. 15 and 16 show another transport packaging 100 for holding a plurality of containers 5. In this case, no outer box is included; that is, the transport packaging 100 just comprises the tray formation 105 with the first and second tray parts 110, 120. In the sectional view of FIG. 16, it can be seen that the pockets 140 of the first and second tray parts 110, 120 are configured to secure containers 5 on their two ends. A first end 10 forms a shoulder 10*a* merging into a neck part 10*b* and a second end 12 forms a bottom part. To this end, the pockets 140 of the first tray 110 have a first side wall 140*a* (defining a larger diameter) configured for confining the shoulder part 10*a* of the container 5 and a second side wall 140*b* (defining a smaller diameter) configured for confining the neck part 10*b*. An exemplary embodiment, which is illustrated here, provides that the second tray part 120 is identical to the first tray part 110, such that the second tray part 120 also has the first and second side walls 140*a*, 140*b*. The first side wall 140*a* (defining the larger diameter) is configured for confining the second end 12 forming the bottom of the containers.

Figure 17:
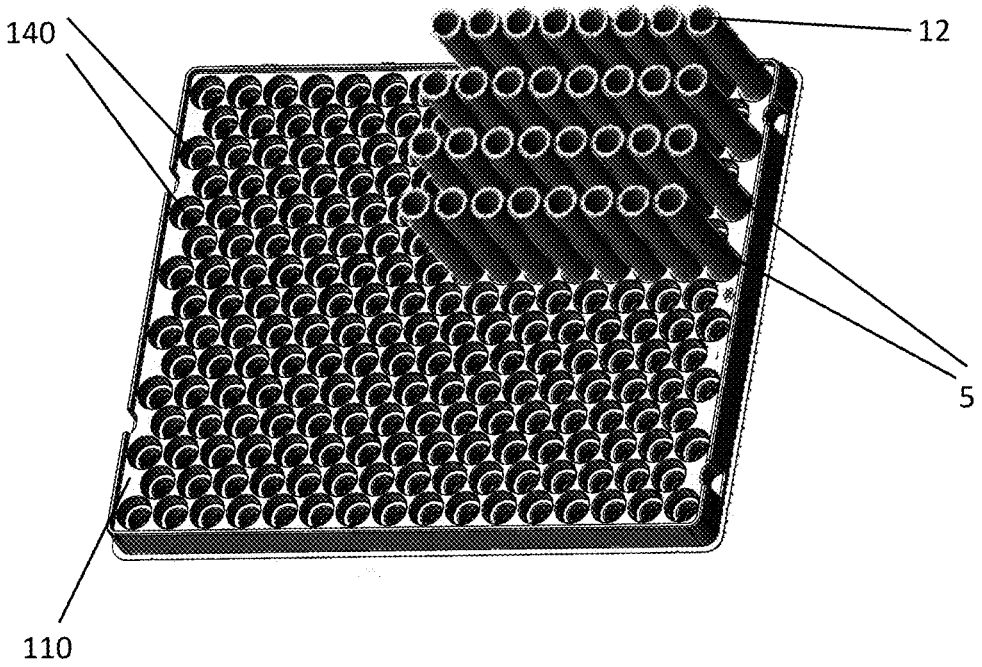
FIG. 17 is a three-dimensional view of a tray part holding containers in its pockets.
Figure 18:
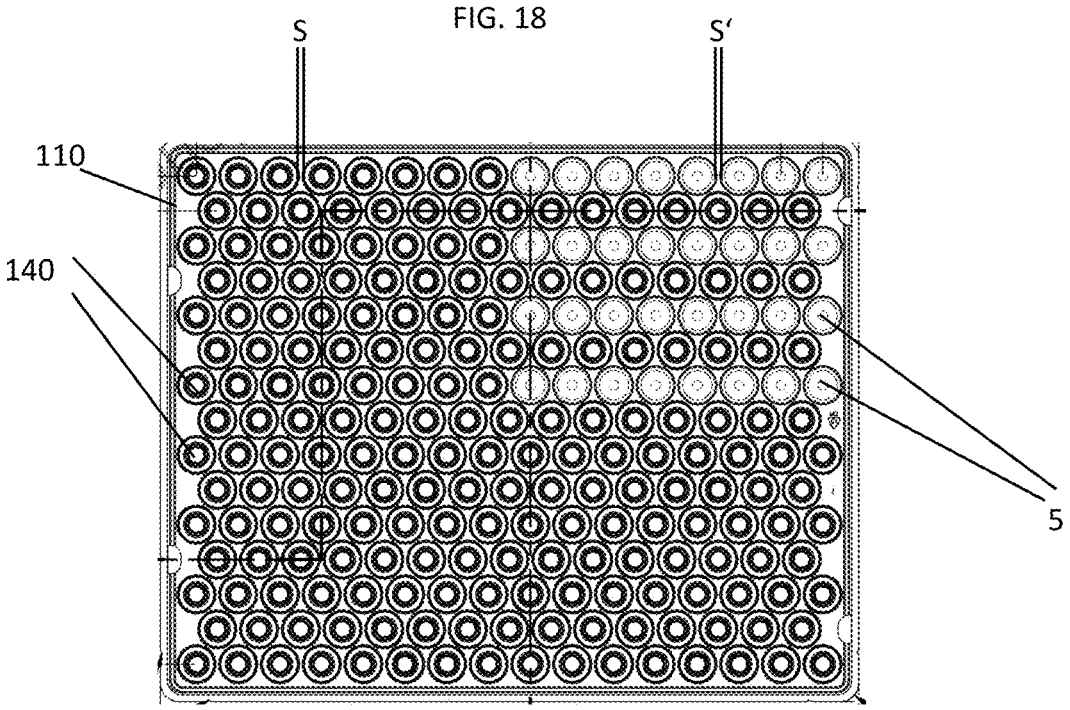
FIG. 18 is an upper view of a tray part holding containers in its pockets.

When the second tray part 120 is absent (as seen in FIGS. 17 and 18) the containers 5 can be aligned in the pockets 140 of the first tray part 110. The pockets 140 are spaced apart from one another by a spacing S such as to define a spacing S' between the containers 5, so as to avoid container-to-container contact.

Figure 19:
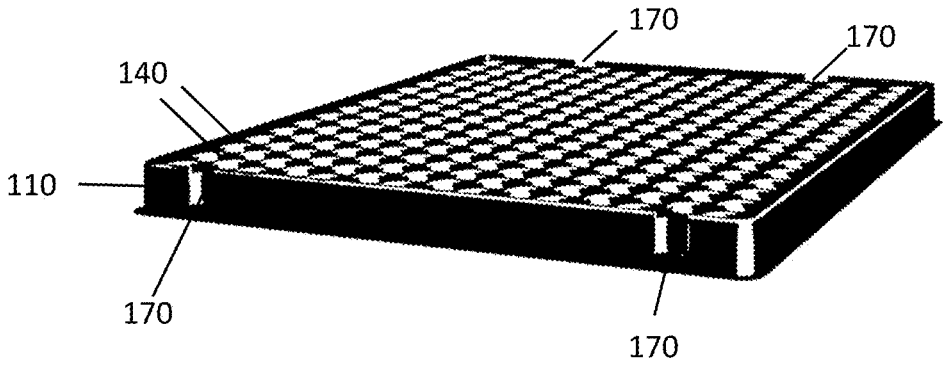
FIG. 19 is a three-dimensional view of an empty tray part.
Figure 20:
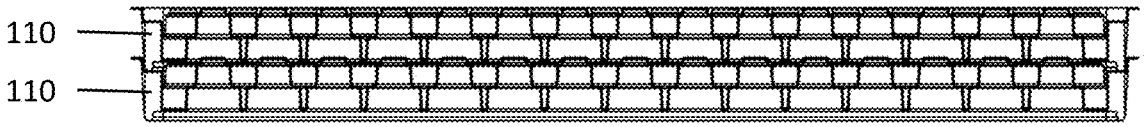
FIG. 20 is a side view of two identical empty tray parts stacked on top of each other.

FIG. 19 depicts the single tray part 110, which has two recesses 170 on two opposing peripheral sides, respectively. Such recesses in a peripheral edge of the tray part 110 are provided to ensure that trays parts do not stick together when stacked. Advantageously, multiple tray parts 110 can be stacked on top of each other as is seen in FIG. 20. In particular, the recesses may allow for an A-B stacking configuration such that the pockets do not sit inside each other when stacked.

Figure 21:
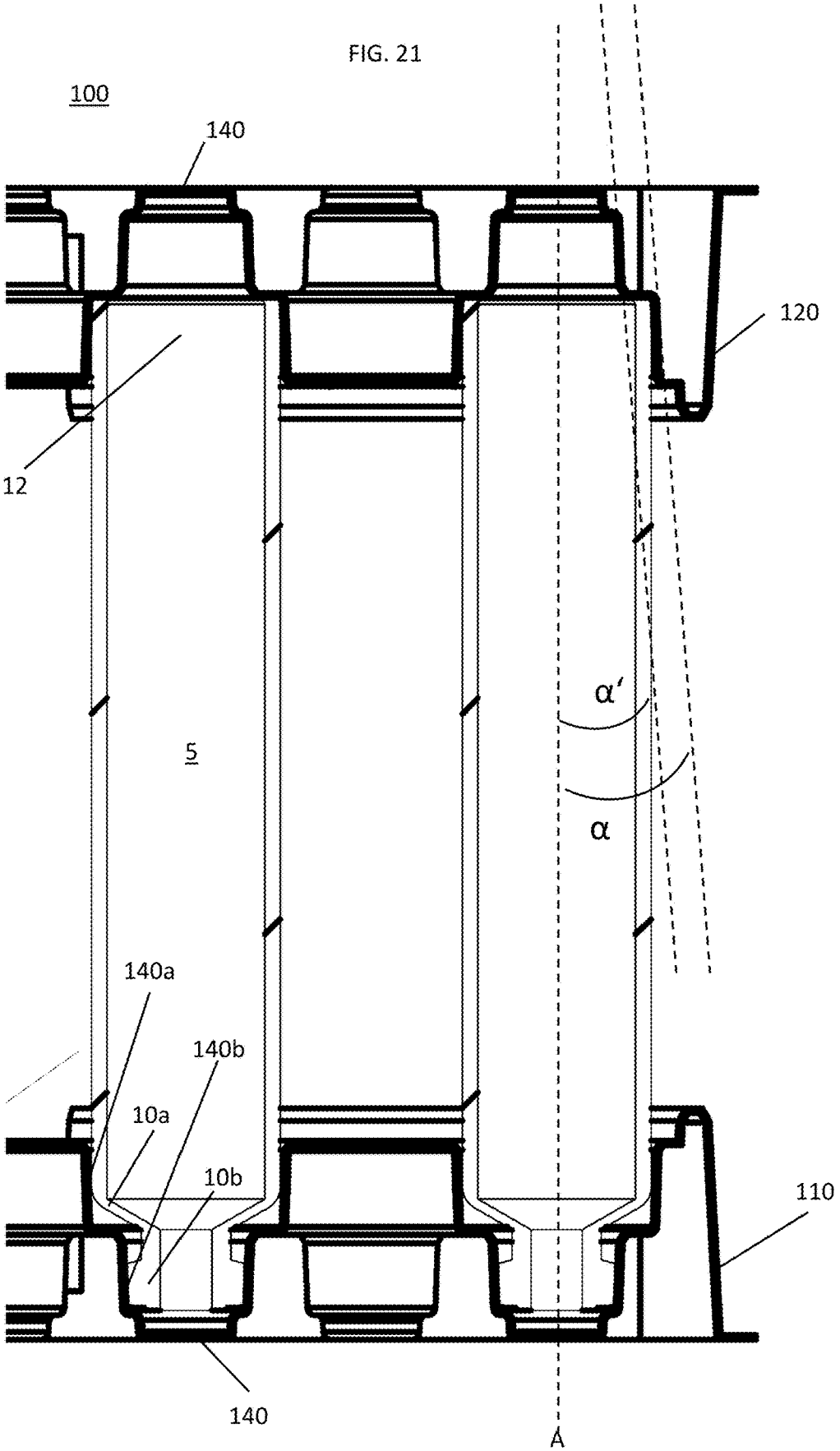
FIG. 21 is an enlarged part of the sectional view of the tray formation of FIG. 16.

Referring to FIG. 21, showing an enlarged part of the sectional view of a tray formation of FIG. 16, the pockets 140 of the first tray part 110 have at least one side wall 140*a* and/or 140*b* for laterally securing the first ends 10 of the containers 5. In order to facilitate that the free ends of the containers 5, here the second ends 12 (which are free when the second tray part 120 is removed) can be brought into mutual contact (e.g. by an unpacking tool 300), the at least one side wall 140*a* and/or 140*b* is inclined with respect to the longitudinal axis A of the containers at an inclination angle $\alpha$ and/or $\alpha'$. It may be the case that the slope of the side walls 140*a* and 140*b* are the same. The inclination angle $\alpha$ and/or $\alpha'$ of the pocket side wall of the first tray part 110 not only facilitates that, when the second tray part 120, is removed, the free second ends 12 of the containers 5 can be brought into mutual contact, but may also facilitate that the first tray part 110 can be removed such that, during its removal, the first ends 10 of the containers 5 gradually come closer to each other, which helps prevent damage to the containers due to knocking together.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A transport packaging, comprising:

a tray formation which is configured to hold a plurality of containers with mutual separation to avoid mutual contact of the containers, the tray formation comprising:

a first tray part having a plurality of pockets configured to receive first ends of the containers; and a second tray part removably coupled to the first tray part and having a corresponding plurality of pockets configured to receive second ends of the containers, the first tray part being formed such that, when the second tray part is removed so that the second ends of the containers are free from the pockets of the second tray part, the free second ends of the containers are free to be brought into mutual contact while the first ends of the containers are still received in the pockets of the first tray part, wherein the pockets of the first tray part and the pockets of the second tray part are identical.

2. The transport packaging of claim 1, wherein the first tray part is formed such that, when the second tray part is removed and the free second ends of the containers are brought into mutual contact, the first tray part is removable such that, during its removal, the first ends of the containers gradually approach each other, until, when the first tray part is completely removed, the first ends come into mutual contact.

3. The transport packaging of claim 1, wherein the pockets of the first tray part have a side wall configured to laterally secure the first ends of the containers, and wherein the side wall is inclined at an angle of inclination with respect to a longitudinal axis of the containers to allow at least one of:

the free second ends of the containers to be brought into mutual contact; or the first ends of the containers to gradually approach each other until the first ends come into mutual contact.

4. The transport packaging of claim 3, wherein the angle of inclination is in the range of 2° to 8°.

5. The transport packaging of claim 1, wherein the pockets of the first tray part are arranged in a regular grid, the pockets of the first tray part comprise at least seven pockets, and the at least seven pockets comprise a specific pocket arranged such that an adjacent six pockets of the at least seven pockets are spaced apart with the same spacing to the specific pocket in order to allow at least one of:

the free second ends of the containers to be brought into mutual contact; or the first ends of the containers to gradually approach each other until the first ends come into mutual contact.

6. The transport packaging of claim 5, wherein the spacing between the specific pocket and its adjacent six pockets is in the range of 0.25 mm to 2 mm.

7. The transport packaging of claim 1, wherein the plurality of pockets of the first tray part comprises at least ten pockets.

8. The transport packaging of claim 1, wherein the first tray part comprises plastic and/or has a thickness in the range of 0.6 mm to 1 mm.

9. The transport packaging of claim 1, wherein the first tray part and the second tray part are configured to hold containers having at least one of a first end forming a shoulder merging into a crimp neck, a second end forming a bottom, or vice versa.

10. The transport packaging of claim 9, wherein at least one of:

the pockets of the first tray part have a side wall defining a larger diameter configured to accommodate or laterally secure the shoulder of the container and another side wall defining a smaller diameter configured to accommodate or laterally secure the crimp neck of the container;

the pockets of the second tray part have a side wall configured to laterally secure the bottom of the container; or vice versa.

11. The transport packaging of claim 9, wherein the first tray part and the second tray part are identical such that the pockets of both the first tray part and the second tray part have a side wall defining a larger diameter configured to accommodate or laterally secure either the shoulder of the container or the bottom of the container and another side wall defining a smaller diameter configured to accommodate or laterally secure the crimp neck of the container.

12. The transport packaging of claim 1, further comprising an outer box for inserting the tray formation.

13. The transport packaging of claim 1, further comprising:

a plurality of containers, each of the containers being held in a respective one of the pockets of at least one of the first tray part or the second tray part; and an unpacking device defining an inner cavity configured to receive the containers in an arrangement with mutual separation and to convey the containers into an arrangement with mutual contact.

14. The transport packaging of claim 13, wherein the unpacking device comprises at least two corner parts defining the inner cavity, wherein the at least two corner parts are movably coupled together to increase or decrease a size of the inner cavity.

15. The transport packaging of claim 14, wherein at least one of:

the at least two corner parts are elastically movable relative to each other; or the unpacking device further comprises an elastic rubber band enclosing the at least two corner parts.

16. The transport packaging of claim 14, wherein at least one of:

the at least two corner parts are slidably coupled together; or at least two adjacent corner parts of the at least two corner parts are slidably attached to each other such that a finger member of one corner part is slidably received in a guiding channel of an adjacent corner part.

17. The transport packaging of claim 13, wherein the inner cavity of the unpacking device is formed by a funnel, the funnel comprising a larger end configured to receive the containers in an arrangement with mutual separation and a smaller end configured to release the containers in an arrangement with mutual contact.

18. The transport packaging of claim 17, wherein the larger end of the funnel is formed as a larger rectangular section and the smaller end of the funnel is formed as a smaller rectangular section, wherein the smaller rectangular section is centered or laterally offset with respect to the larger rectangular section.

19. A tray formation for holding a plurality of containers, comprising:

a first tray part comprising a plurality of pockets configured to receive first ends of the containers; and a second tray part comprising a corresponding plurality of pockets configured to receive second ends of the containers, the first tray part and the second tray part being configured to hold containers having at least one of a first end forming a shoulder merging into a crimp neck or a second end forming a bottom, or vice versa, the first tray part being identical to the second tray part such that the pockets of both the first tray part and the second tray part have a side wall defining a larger diameter configured to accommodate or laterally secure either the shoulder of the container or the bottom of the container and another side wall defining a smaller diameter configured to accommodate or laterally secure the crimp neck of the container, wherein the pockets of the first tray part and the pockets of the second tray part are identical.

20. A package, comprising:

a tray formation comprising a first tray part having a plurality of first pockets and a second tray part removably coupled to the first tray part and having a corresponding plurality of second pockets that are each aligned with a respective one of the first pockets to form a container holder, wherein the first pockets and the second pockets are identical; and a plurality of containers each held in a respective container holder in mutual separation from one another, each of the containers comprising a first end held in a respective one of the first pockets and a second end held in a respective one of the second pockets, the first tray part being configured such that, when the second tray part is removed so that the second ends of the held containers are free from the pockets of the second tray part, the free second ends of the held containers are free to be brought into mutual contact while the first ends of the held containers are still received in the pockets of the first tray part.

* * * * *